US006076462A

United States Patent [19]

Schäfer et al.

[11] Patent Number: 6,076,462

[45] Date of Patent: Jun. 20, 2000

[54] METHOD FOR INKING A CYLINDER WITH VISCOUS INK USING DOCTOR BLADES

[75] Inventors: Karl Robert Schäfer, Rimpar; Georg Schneider, Würzburg, both of Germany

[73] Assignee: Koenig & Bauer Aktiengesellschaft, Wurzburg, Germany

[21] Appl. No.: 09/319,942

[22] PCT Filed: Dec. 22, 1997

[86] PCT No.: PCT/DE97/02991

§ 371 Date: Sep. 23, 1999

§ 102(e) Date: Sep. 23, 1999

[87] PCT Pub. No.: WO98/28140

PCT Pub. Date: Jul. 2, 1998

[30] Foreign Application Priority Data

Dec. 21, 1996 [DE] Germany ..... 196 53 812

[51] Int. Cl.[7] ..... B41F 31/02; B41F 31/04

[52] U.S. Cl. ..... 101/350.6; 101/363; 101/DIG. 34

[58] Field of Search ..... 101/350.1, 350.6, 101/363, 364, 366, 367, DIG. 34, 155, 157, 167, 169

[56] References Cited

U.S. PATENT DOCUMENTS

| | | | |
|---|---|---|---|
| 2,399,688 | 5/1946 | Metzner et al. | 101/364 |
| 2,534,320 | 12/1950 | Taylor | 101/169 |
| 3,457,858 | 7/1969 | Gibbs | 101/363 |
| 3,730,089 | 5/1973 | McCutcheon | 101/363 |
| 4,158,333 | 6/1979 | Navi | 101/363 |
| 4,667,595 | 5/1987 | Geretzki | 101/366 |
| 4,982,660 | 1/1991 | Hamm et al. | 101/157 |
| 5,427,136 | 6/1995 | Weishew | 101/364 |
| 5,517,917 | 5/1996 | Hartung et al. | 101/363 |
| 5,520,110 | 5/1996 | Tittgemeyer | 101/363 |
| 5,560,294 | 10/1996 | Anders et al. | 101/366 |

FOREIGN PATENT DOCUMENTS

| | | |
|---|---|---|
| 3505598 A1 | 4/1986 | Germany . |
| 4239808 A1 | 6/1992 | Germany . |
| 4334803 C1 | 11/1994 | Germany . |

*Primary Examiner*—John S. Hilten
*Assistant Examiner*—Leslie J. Grohusky
*Attorney, Agent, or Firm*—Jones, Tullar & Cooper, P.C.

[57] ABSTRACT

A cylinder in a rotary printing press is inked with a highly viscous printing ink. An open ink duct is provided with a doctor blade that is supported negatively on the cylinder. A reserve of printing ink is added to the ink duct and is formed into an ink roll. A regular and intensive inking of the cylinder results with only very low ink circulation.

6 Claims, 1 Drawing Sheet

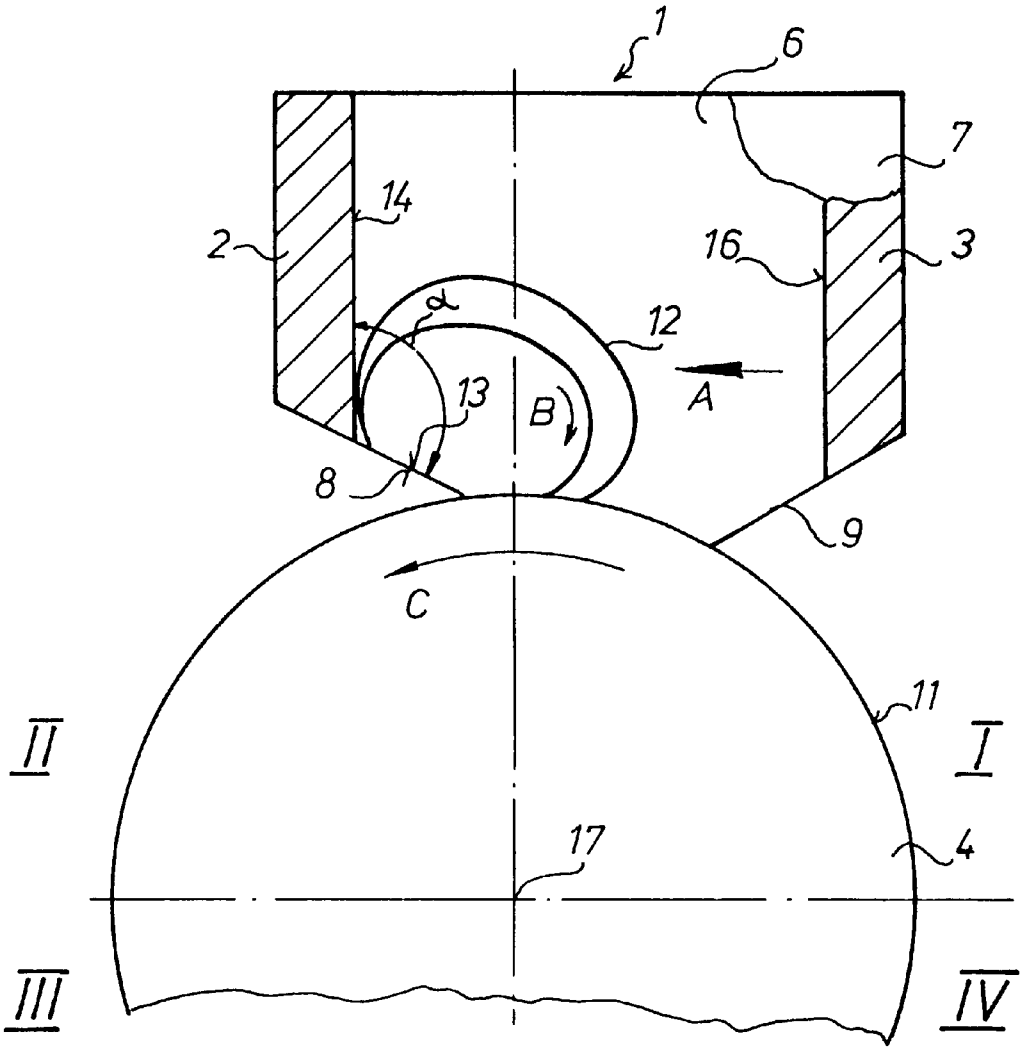
1
2
3
4
6
7
8
9
11
12
13
14
16
17
A
B
C
α
I
II
III
IV

METHOD FOR INKING A CYLINDER WITH VISCOUS INK USING DOCTOR BLADES

FIELD OF THE INVENTION

The present invention relates to an ink unit for a rotary printing press.

A device for inking a screen roller is known from EP 0 663 293 A1, wherein ink rotates in a filled ink duct of circular cross section around an axis extending longitudinally in respect to the screen roller, A negatively applied working doctor blade and a positively applied finishing doctor blade are provided.

A pre-shaped ink duct is required, into which ink is pumped.

U.S. Pat. No. 1,568,299 A1 describes an ink duct with two ink blades, which are spaced apart from each other in the circumferential direction of a metering roller. A thickness of an ink layer to be transferred is determined by means of an adjustable distance of the ink blades from the metering roller.

U.S. Pat. No. 3,730,089 shows an ink duct, in which an ink roll forms in the course of operation. An ink blade is spaced apart from a metering roller for metering the ink.

SUMMARY OF THE INVENTION

The object of the present invention is based on providing an inking unit for a rotary printing press for inking a screen roller with highly viscous ink.

In accordance with the invention, this object is attained by using an unpressurized ink duct having a negatively applied working doctor blade, and a positively applied finishing doctor blade. During operation of the printing press a rotating ink roll of the highly viscous ink is formed. This rotating ink roll rolls off the working doctor blade without touching the finishing doctor blade.

The advantages which can be achieved by means of the present invention lie, in particular, in that little ink is circulating, which is of advantage when cleaning the ink duct and when changing ink. Because of the absence of a specially shaped ink duct, the rotating ink roll is located undisturbed and evenly, which also leads to even and intensive inking of the cylinder.

BRIEF DESCRIPTION OF THE DRAWING

A preferred embodiment of the present invention is represented in the sole drawing figure and will be described in greater detail in what follows, The single drawing represents a cross section through a schematic representation of an ink duct with two doctor blades, which is placed on a cylinder.

DESCRIPTION OF THE PREFERRED EMBODIMENT

An ink duct 1, open at the top, has a left lateral wall 2 and a right lateral wall 3, as well as two sealing end walls 6, 7, matched to the periphery I I of a driven cylinder 4. The ink duct 1 extends over the entire length of the cylinder 4 which can be embodied as a screen roller. A working doctor blade 8, which is negatively applied to the cylinder 4, as well as a finishing doctor blade 9 are exchangeably applied at the bottom of the lateral walls 2, 3.

Highly viscous ink is present in the ink duct I which, during the operation of the press, forms an ink roll 12, which is movable in the horizontal direction A and rotates in a clockwise direction B. Corresponding to the direction of rotation of the cylinder 4, for example in a counterclockwise direction C, the ink roll 12 rests against a portion of the peripheral surface 11 of the cylinder 4, as well as on a working surface 13 of the working doctor blade 8, as well as on a guide surface 14, which delimits the ink roll 12 in the production direction C of the cylinder 4.

The guide surface 14 is formed, for example, by the inside surface of the left lateral wall 2 and extends at an obtuse angle , preferably of 110° to 130°, with respect to the working surface 13 of the working doctor blade 8.

The working surface 13 of the working doctor blade 8 is formed by the free doctor blade width, as well as the length of the working doctor blade 8.

It is also possible to let the cylinder 4 run in a clockwise direction, so that the doctor blade 9 becomes the working doctor blade and the doctor blade 8 becomes the finishing doctor blade. The ink roll 12 now rests against the doctor blade 9, as well as on the inner surface of the right lateral wall 3, which inner surface forms a guide surface 16.

The ink duct 1 is arranged, at the periphery 11 of the driven cylinder 4, between the I. and II., or in the I., or in the II. quadrant of a right-angled coordinate system extending through the axis of rotation 17 of the cylinder.

In accordance with another preferred embodiment, it is possible, depending on the direction of rotation of the cylinder 4, for example in the direction C, to use only one doctor blade, i.e. only the negatively applied working doctor blade 8, as well as the two end walls 6, 7. Depending on the size of the value of the angle , the doctor blade 8 can work together with only one lateral wall 2 in this case. If the angle lies within the range of 180°, the working surface 13 as well as the guide surface 14 are in the same plane and can therefore also be definitely designed.

During the operation of the press, sufficient ink is introduced, for example into the ink duct 1, so that an ink roll 12 is formed, which rests on a part of the surface 11 of the cylinder 4 with a component of its weight, and is delimited by the free working surface 13 of the working doctor blade 8, as well as by the guide surface 14.

The ink has a viscosity greater than 60 poise.

While preferred embodiments of an ink unit in accordance with the present invention have been set forth fully and completely hereinabove, it will be apparent to one of skill in the art that a number of changes in, for example the drive assembly for the roller, the means for supplying ink to the ink duct and the like can be made without departing from the true spirit and scope of the present invention which is accordingly to be limited only by the following claims.

What is claimed is:

1. A method for inking a cylinder of a rotary printing press including:

providing an unpressurized ink duct;

positioning said ink duct in contact with a screen roller having a peripheral surface;

supporting a working doctor blade in said ink duct and negatively applying said working doctor blade without a space directly against said peripheral surface of said screen roller;

supporting a finishing doctor blade in said ink duct and positively applying said finishing doctor blade without a space directly against said peripheral surface of said screen roller;

delivering a supply of highlyviscous ink to said ink duct during operation of the rotary printing press; and forming a rotating ink roll in said ink duct, said rotating ink roll rolling off on said working doctor blade and not touching said finishing doctor blade.

2. The method of claim 1 further including forming a guide surface on said working doctor blade and using said guide surface to delimit said ink roll.

3. The method of claim 2 further including forming an obtuse angle between a free working surface of said working doctor blade and said guide surface.

4. The method of claim 3 further including forming said obtuse angle between 110° to 130°.

5. The method of claim 2 further including locating said guide surface in one of quadrants I and II of a right-angled coordinate system having its origin on an axis of rotation of said cylinder.

6. The method of claim 1 further including providing said ink with a viscosity of greater than 60 poise.

* * * * *